US006733232B2

(12) United States Patent
Ingistov et al.

(10) Patent No.: US 6,733,232 B2
(45) Date of Patent: May 11, 2004

(54) EXTENDED TIP TURBINE BLADE FOR HEAVY DUTY INDUSTRIAL GAS TURBINE

(75) Inventors: Steve Ingistov, Los Angeles, CA (US); Robert Pistor, Burlington (CA)

(73) Assignee: Watson Cogeneration Company, Carson, CA (US)

( * ) Notice: Subject to any disclaimer, the term of this patent is extended or adjusted under 35 U.S.C. 154(b) by 2 days.

(21) Appl. No.: 10/195,687

(22) Filed: Jul. 15, 2002

(65) Prior Publication Data

US 2003/0026690 A1 Feb. 6, 2003

Related U.S. Application Data

(60) Provisional application No. 60/309,366, filed on Aug. 1, 2001.

(51) Int. Cl.[7] ..... F01D 5/18

(52) U.S. Cl. ..... 415/115; 415/173.6; 416/92; 416/97 R

(58) Field of Search ..... 415/173.1, 173.6, 415/115; 416/92, 97 R

(56) References Cited

U.S. PATENT DOCUMENTS

| | | | | | |
|---|---|---|---|---|---|
| 4,390,320 | A | * | 6/1983 | Eiswerth | 416/97 R |
| 4,893,987 | A | * | 1/1990 | Lee et al. | 416/92 |
| 6,059,530 | A | * | 5/2000 | Lee | 416/97 R |
| 6,179,556 | B1 | * | 1/2001 | Bunker | 415/115 |

* cited by examiner

*Primary Examiner*—Ninh H. Nguyen
(74) *Attorney, Agent, or Firm*—E. Lindsey Scott; Patrick J. Kim

(57) ABSTRACT

An improved turbine blade having a tip configured to provide a reduced blade tip clearance between the blade tip and the inside of a turbine casing and to provide an improved flow path for the discharge of cooling air from the turbine blade tip.

10 Claims, 3 Drawing Sheets

EXTENDED TIP TURBINE BLADE FOR HEAVY DUTY INDUSTRIAL GAS TURBINE

RELATED CASES

This application is entitled to and hereby claims the benefit of the filing date of provisional application 60/309,366, filed Aug. 1, 2001.

FIELD OF THE INVENTION

Gas turbines are widely used to convert hot gases into energy, especially electricity. Such turbines basically comprise a plurality of turbine blades positioned on a turbine wheel for rotation as a result of the flow of high pressure gases past the turbine blades to cause the wheel to rotate, thereby rotating a shaft coupled to the wheel to produce energy to drive an electrical generator or the like. The present invention provides improved turbine blades, which result in increased efficiency in such turbines.

BACKGROUND OF THE INVENTION

In the use of turbines, for the production of electrical energy by the use of hot, high pressure combustion gases to drive the turbine, the turbine blades are typically configured to a clearance of about 0.20 inches between the outer ends or tips of the turbine blades and the inside of the turbine casing or a shroud or block positioned inside the turbine casing in an annular position in the same vertical plane as the rotation of the turbine blades. This clearance is provided to avoid any contact of the blade tips with the inside of the casing, and in many instances is larger than necessary and results in inefficiency in the operation of the turbine. Similarly, many turbine blades are designed so that cooling air flows outwardly through the turbine blades from a turbine blade wheel and is required to flow through the clearance between the turbine blade tips and the inside of the casing. This results in the design of turbine blades with greater than necessary clearance. This results not only in the flow of the cooling air through the clearance gap between the turbine blade tips and the inside of the casing but also permits hot gas to flow through this clearance gap, thereby bypassing the turbine blades and reducing the amount of energy produced in the turbine by the hot gas.

Since fuels for the generation of the hot high-pressure gases required to drive turbines are expensive, a continuing effort has been directed to the development of improved turbines and turbine components to increase the efficiency of the turbines.

SUMMARY OF THE INVENTION

According to the present invention, an improved turbine blade is provided. The improved turbine blade is configured for use in a turbine having a turbine case and includes an outer turbine blade tip on the turbine blade, which when positioned in the turbine provides a clearance on a high pressure edge of the turbine blade tip of less than 0.180 inches between the turbine blade tip and an inner diameter of the turbine case, the turbine blade tip containing a rim about at least a portion of an exterior of the tip defining an inner tip surface, and a plurality of air outlets for the discharge of cooling air through the inner tip surface.

The present invention further includes an improved turbine blade configured to mount on a turbine blade wheel in a turbine casing and having a high pressure side clearance from about 0.140 to less than 0. 180 inches between the turbine blade tip and an inside surface of the turbine casing, the turbine blade comprising: a turbine blade base adapted for positioning the turbine blade on a turbine blade wheel and an outer end of the turbine blade comprising a turbine blade tip extending outwardly from the turbine blade wheel toward the inside of the turbine case; an air passageway positioned to supply air to an inner passage in the turbine blade; a first rim positioned along a high pressure side of the turbine blade to provide clearance of the turbine blade tip from about 0.140 to less than 0.180 inches; a second rim positioned along at least a portion of a low pressure side of the turbine blade tip to provide a clearance of at least 0.180 to about 0.200 inches or more; an inner surface area between the first and second rims; and, air outlets through the inner surface area and in fluid communication with the air passageway.

The present invention further comprises a turbine comprising: a turbine blade wheel positioned inside a turbine casing on a rotary shaft and adapted to support a plurality of turbine blades; an air passageway positioned in fluid communication with at least a portion of the turbine blades to supply air to a turbine blade including a turbine blade tip; a first rim along a leading edge of at least a portion of the turbine blade tips; a second rim along at least a portion of a trailing edge of the turbine blade tips; a turbine tip surface defined by the area between the first and second rims; and, a plurality of air outlets from the air passageway through the turbine tip surface, the ends of the first rim defining a clearance spacing between the first rim and the inside of the turbine casing from about 0.140 to less than 0.180 inches.

DESCRIPTION OF THE PREFERRED EMBODIMENTS

In the discussion of the Figures, the same numbers will be used throughout to refer to the same or similar components. Further, details of the turbine construction and operation will be discussed only to the extent necessary to fully disclose the present invention.

Figure 1:
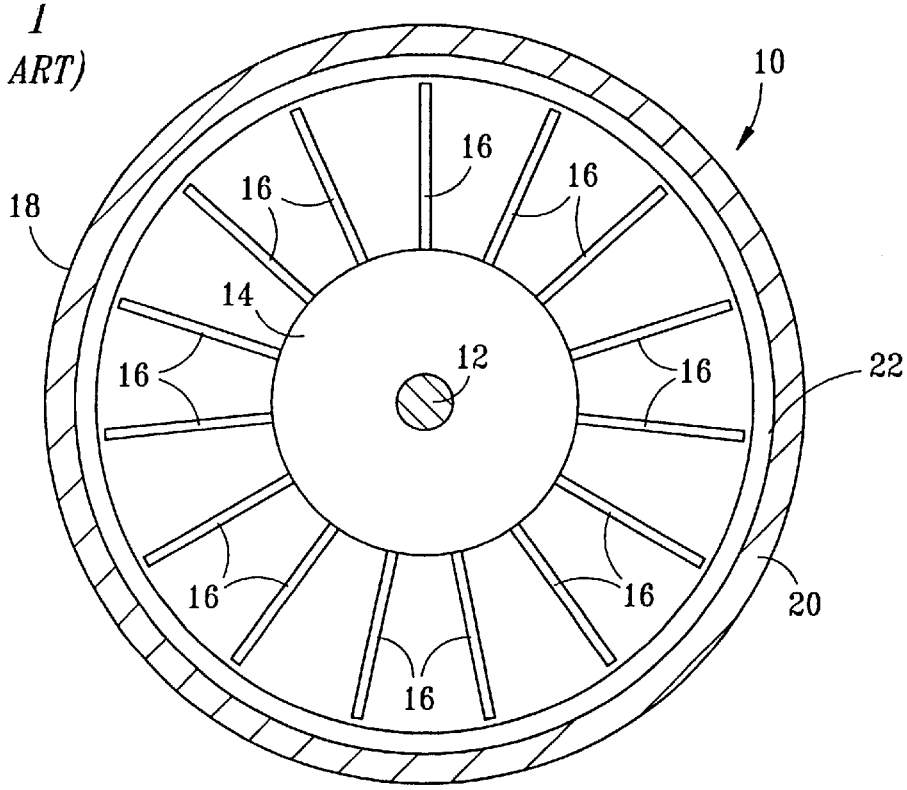
FIG. 1 (PRIOR ART)
FIG. 1 is a schematic front view of a turbine.

FIG. 1 is a schematic front view diagram of a turbine. The turbine 10 comprises a rotary shaft 12 with a turbine blade wheel 14 positioned on rotary shaft 12. A plurality of turbine blades 16 are positioned on turbine blade wheel 14 and extend outwardly to provide a small clearance gap 22 between an inside of a turbine casing 18 shown with a shroud 20 positioned inside turbine casing 18. This is a very generalized showing of prior art turbines with which the improved turbine blades of the present invention are effective. It will be understood that the blades are positioned on the blade wheel at spacings and at angles to optimize the power production from high pressure (typically hot) gases flowed through the turbine.

Figure 2:
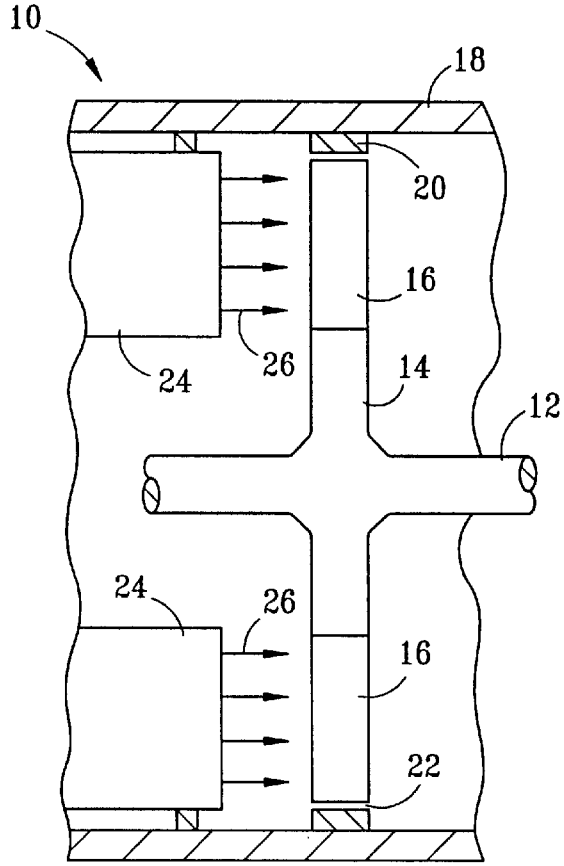
FIG. 2 (PRIOR ART)
FIG. 2 is a side view of a turbine blade wheel and turbine blades mounted in a turbine.

FIG. 2 further demonstrates prior art turbines. In the embodiment shown in FIG. 2, a rotary shaft 12 is co-axially positioned inside a casing 18 and supports a turbine blade wheel 14, which includes a plurality of turbine blades 16, two of which are shown. The shroud 20 is shown as a ring which is positioned around the inside of casing 18 in a common plane with turbine blades 16 so that the turbine blades 16 rotate inside shroud 20 and define a clearance gap 22, which in many commercially available turbines is approximately 0.200 inches.

High pressure and typically hot gas is desirably supplied around the entire perimeter of turbine blade wheel 14 to drive the rotary shaft 12 as shown. For simplicity, the hot gas flow has been shown from a hot gas inlet 24. It should be understood that the hot gas as injected and as shown by arrows 26 is typically injected for flow to and through the blades around the circumference of the blade wheel to drive turbine blades 16. It will be immediately clear that the amount of gas available to drive turbine blades 16 is reduced by any hot gas, which escapes through clearance gap 22. As indicated, this clearance is typically about 0.20 inches to provide suitable clearance and provide a margin of error to avoid contact of the turbine blades 16 with shroud 20 and the like. This gap is also provided to permit the escape of cooling air, which is frequently injected through turbine blades 16 via air passageways (not shown) for escape through the turbine blade tips.

Figure 3:
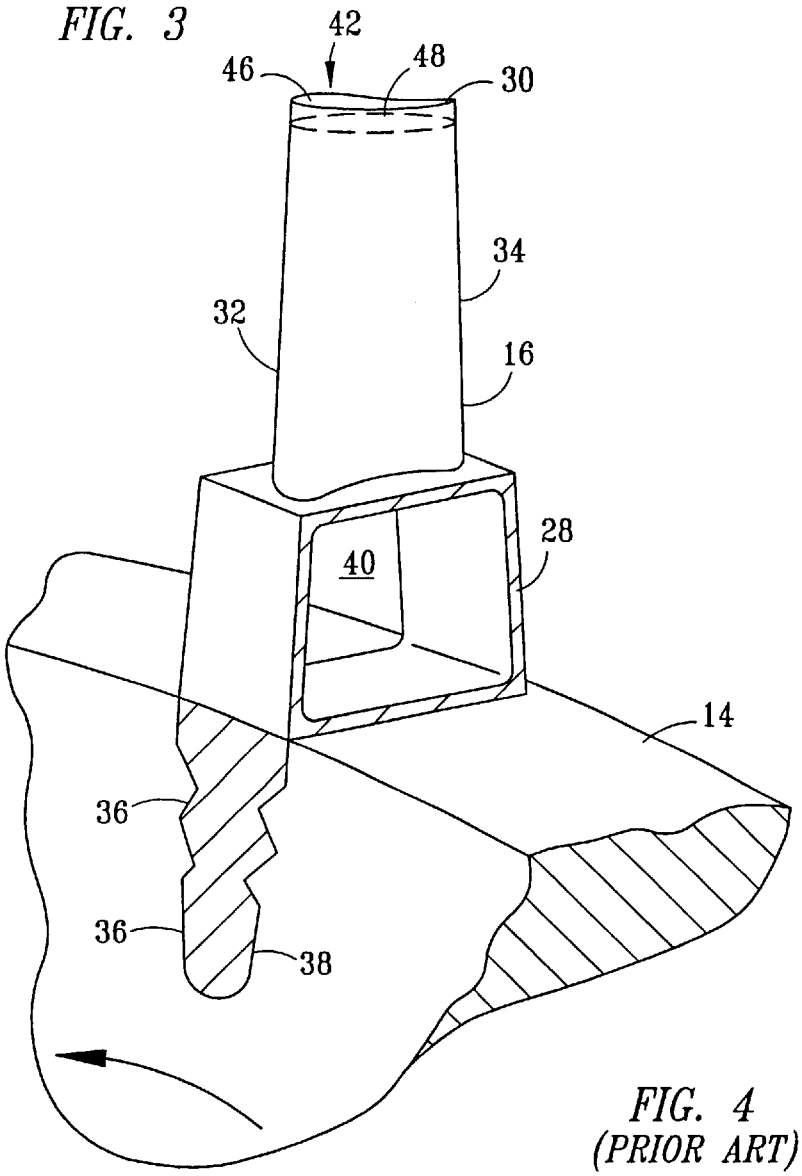
FIG. 3 shows a turbine blade in position on a turbine blade wheel.

In FIG. 3, a more detailed showing of a turbine blade is presented. Turbine blade 16 is shown having a leading edge 32 and a trailing edge 34 with a turbine blade tip 30, which is surrounded by a rim 42 shown by dotted lines. Rim 42 will be discussed in greater detail hereinafter.

Turbine blade 16 also includes or is supported on a shank 28 which is shown as a single member but which typically comprises a plurality of members joined to form an air passageway 40 about the circumference of turbine blade wheel 14. The cooling air supplied to turbine blade 16 can be supplied by a variety of systems but the system shown is illustrative of one method for supplying cooling air to turbine blades 16. Such systems are well known and need not be discussed in further detail. Turbine blade wheel 14 as shown, includes a plurality of receptacle fittings 38, which are configured to accept a fitting 36 positioned on the bottom of shank 28 or turbine blade 16. This is a commonly used method for positioning turbine blades 16 on turbine blade wheel 14. Other positioning means could be used and are considered to be within the scope of the present invention.

Figure 4:
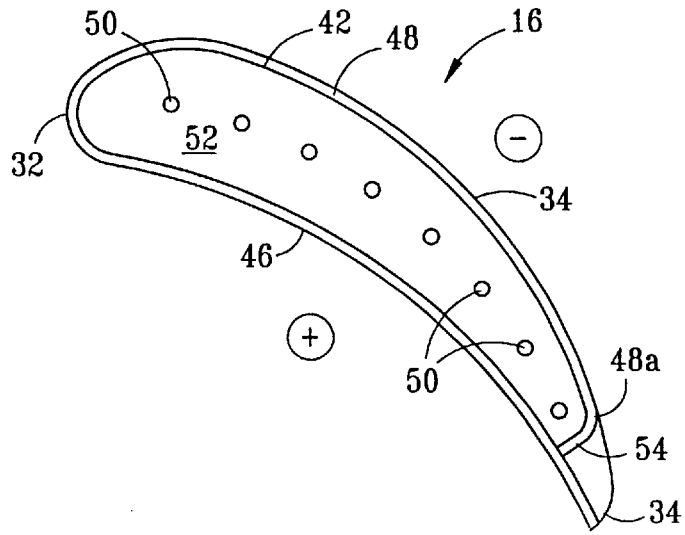
FIG. 4 (PRIOR ART)
FIG. 4 is a top view of a prior art turbine blade tip.

An important feature of the present invention is the configuration of the turbine blade rim 42. In FIG. 4, a prior art turbine blade 16 is shown. In the prior art turbine blade shown in FIG. 4, a first rim 46 is shown extending along the high-pressure surface of a turbine blade tip 16. This rim extends to a height that defines the clearance between the tip of turbine blade 16 and the shroud. The high-pressure side of the blade shown in FIG. 4 is indicated by ⊕ and the low-pressure side is indicated by ⊖.

A leading edge 32 and a trailing edge 34 of turbine blade 16 are arranged so that the hot gases flowing toward and past turbine blades 16 contact the concave surface, (high pressure side) and leading edge 32, of turbine blade 16 and produce a positive pressure on the concave side of turbine blade 16. The blades are arranged at an angle to optimize energy recovery from a high-pressure gas stream. Conversely, a reduced pressure zone trailing edge 34 is present on the back or convex side (low pressure side) of turbine blade 16. A Rim 46 extends along the length of the concave side. A similar rim 48 extends around the convex side and may end at a point 48*a*. These rims are of substantially the same height.

The prior art turbine tip may also include a dam 54. Dam 54 is typically of a slightly lower height than rims 46 and 48. Rims 46 and 48 define the tip of the turbine blade 16 and define the clearance between the tip of the turbine blade and the shroud. Cooling air flows upwardly through air outlets 50. The air flows upwardly into an area between rims 46 and 48 that defines a turbine blade tip surface 52, which lies between rims 46 and 48. The air passed into the space between rims 46 and 48 cannot escape from this area except over the tops of rims 46 and 48 or dam 54. The requirement for this air escape adds to the tendency to increase the clearance between the ends of rims 46 and 48 and the shroud. The presence of dam 54 ensures that most of the air must escape through the clearance between the ends of rims 46 and 48 and the shroud. Similarly, the air passed to the portion of the prior art turbine tip between the dam and the trailing edge of the turbine blade may be less restricted in its ability to escape, since it may escape past the end 48*a* of rim 48.

Figure 5:
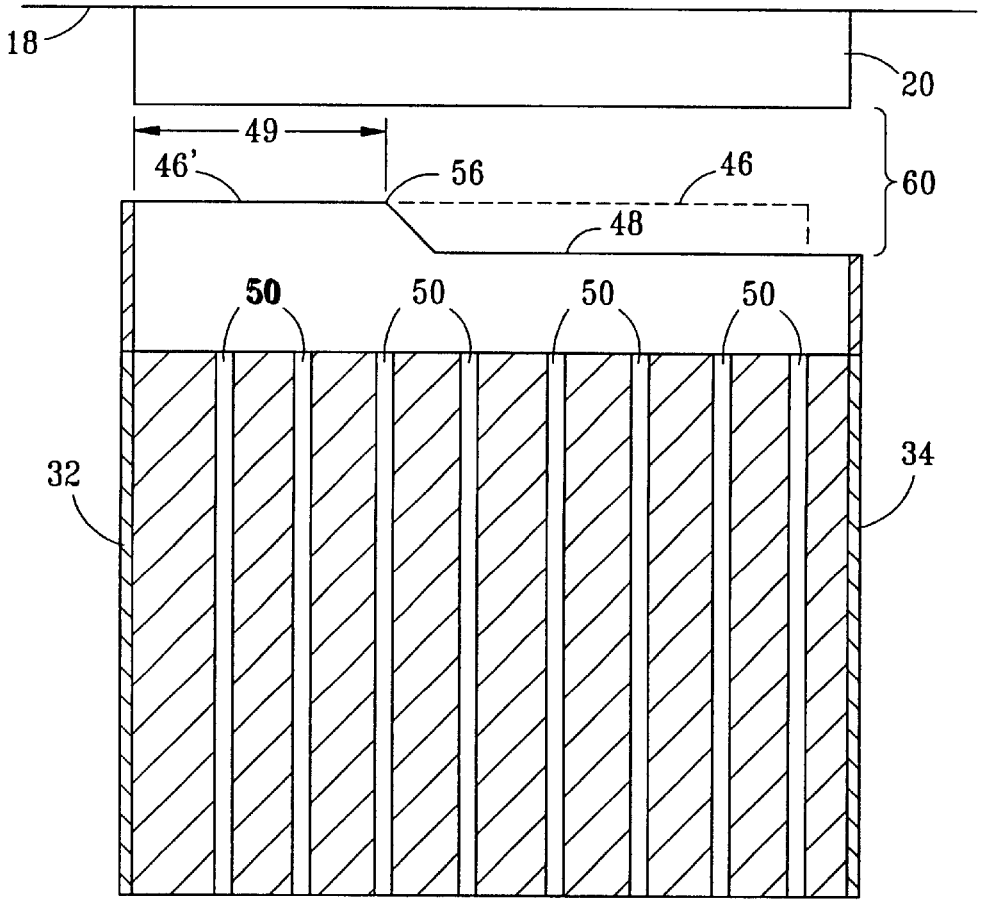
FIG. 5 is a cross-sectional side view of a turbine blade showing the rims around the turbine blade tip surface and the gap between the turbine blade tip and the inside of the turbine case; and, FIG. 6 is a top view of a turbine blade tip according to the present invention.

According to the present invention, a cross-sectional view of an improved turbine blade tip taken from the concave side of the turbine blade tip is shown in FIG. 5. In this turbine blade, a rim 46 shown as a doted line 46 of a greater height is positioned around the concave (higher pressure) side of turbine blade 16 with a similar rim 46, extending around the tip of concave (higher pressure) section of the turbine blade to a point 56, which is at a distance 49 from the tip of the concave side of the tip of the turbine blade.

The higher rim 46 on the embodiment shown in FIG. 5 results in a reduced clearance from about 0.140 to less than 0.180 inches thereby increasing the efficiency of turbines so equipped. It is considered that with each reduction of 0.02 inches in the clearance, a one mega-watt power increase is realized. The rim 46 extends from leading edge 32 to a point 56 between leading edge 32 and trailing edge 34. Typically rim 46 extends along the trailing edge to a point intermediate the leading edge and the trailing edge and nearer to the leading edge of the turbine blade tip and preferably from about 0.50 to about 1.0 inches from leading edge 32 toward trailing edge 34 on the convex side. The rim 48 on the convex side between point 56 and trailing edge 34 is at a height to provide a clearance greater than 0.180 and up to 0.200 inches or greater. This permits the escape of the air on the low pressure side of the turbine blade so that it is unnecessary to have extra clearance on rim 46 to permit the escape of the cooling air. Air outlets 50 are in fluid communication with air passageway 40. No dam 54 is included in the embodiment in FIG. 5.

Figure 6:
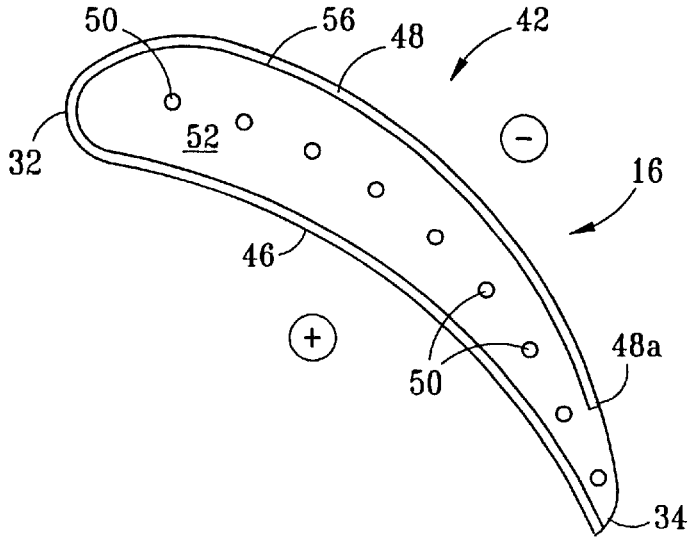

In FIG. 6, a top view of a turbine blade tip according to the present invention is shown. In this blade tip no dam 54 is included. As shown, rim 48 is of a clearance greater than 0.180 and up to 0.200 inches or greater. This lower rim height permits the escape of air over the trailing edge of the blade as discussed above. As indicated previously, no dam 54 is included in the embodiment shown in FIG. 6 and the rim section 48 is at a height less than rim 46. Accordingly, increased clearance is available over rim 48 so that air can readily escape from the trailing edge of the turbine blade. This permits reduced loss of the high-pressure gases charged to the turbine while still permitting the escape of the cooling air passed through holes 50.

Air ejected through air outlets 50 must flow upwardly and into a clearance 60 between the end of rim 48 and shroud 20. This clearance is of necessity wide enough to accommodate the escape of the cooling air. Cooling air injected between rim 46 and rim 48 must escape over the top of either rim 46 or rim 48. Since this air inherently escapes over rim 48, rim 48 is desirably of a height to provide sufficient clearance for the escape of the air, i.e., a clearance of greater than 0.180 and up to about 0.200 inches or more.

Contrary to past practice, it is not necessary to provide clearance for the escape of the air over rim 46. Desirably this rim provides the minimum clearance consistent with mechanical installation and operation of the turbine. According to the present invention, rim 46 provides less clearance than rim 48. The clearance between the shroud and rim 46 is desirably from about 0.140 to less than 0.180 inches and preferably from about 0.170 to 0.179 inches. The clearance between the shroud and rim 48 is typically greater than 0.180 and up to 0.200 inches or more. Typically prior art turbine blade tips had rims of substantially the same clearance on both the concave higher-pressure side and on the convex lower pressure side. The clearance was sufficient on both sides to allow the escape of the cooling air, which inherently escapes predominantly over the convex side rim. The configuration of prior art turbine blade tips may vary widely in detail but are believed to include rims of substantially the same height on both the concave and convex sides.

It will be noted that in FIG. 5, rim 46 extends along the entire length of the concave (high pressure) side of turbine blade 16. This provides a much lower clearance for the escape of high pressure gas used to drive the turbine as shown for instance at arrows 26 in FIG. 2, past the tips of the turbine blades.

According to the present invention, the clearance at the turbine tips has been greatly reduced, the air escape is not impeded and greater efficiency has been provided in turbine operation. The reduced clearance has been made possible by providing the clearance for cooling air discharge from the tips of the turbine blades into the clearance zone between the tip of rim 48 and the inside of the turbine casing (the shroud) while reducing the clearance between rim 46 and the inside of the turbine casing.

Having thus described the invention by reference to certain of its preferred embodiments, it is pointed out that the embodiments described are illustrative rather than limiting in nature and that many variations and modifications are possible within the scope of the present invention.

What is claimed is:

1. In a turbine blade configured for use in a turbine including a turbine case and having an outer turbine blade tip which when positioned in the turbine provides a clearance greater than 0.180 inches between a leading edge of the turbine blade tip and an inner diameter of the turbine case, the turbine blade tip including a rim about an exterior of the tip surface to define an inner tip surface, a plurality of air outlets for the discharge of cooling air through the inner tip surface; an improvement comprising reducing the clearance between a rim on a leading edge of the turbine blade and the inside of the turbine to from about 0.140 inches to less than 0.180 inches.

2. The improvement of claim 1 wherein the reduced clearance is from about 0.170 to about 0.179 inches.

3. In a turbine blade configured for use in a turbine including a turbine case and having an outer turbine blade tip which when positioned in the turbine provides a clearance greater than 0.180 inches between a leading edge of the turbine blade tip and an inner diameter of the turbine case, the turbine blade tip including a rim about an exterior of the tip surface to define an inner tip surface, a plurality of air outlets for the discharge of cooling air through the inner tip surface; an improvement comprising reducing the clearance between a rim on a leading edge of the turbine blade and the inside of the turbine to from about 0.140 inches to less than 0.180 inches and extending the rim along a lower pressure side of the turbine blade to a position intermediate an upstream end and a downstream end of and nearer to the upstream end of the turbine blade tip.

4. An improved turbine blade configured to mount in a turbine having a turbine casing having an inside, the improved turbine blade having:

a) a turbine blade base adapted for positioning the turbine blade with an outer end of the turbine blade comprising a turbine blade tip extending outwardly from a turbine blade wheel in the turbine casing toward the inside of the turbine casing;

b) an air passageway positioned in the turbine blade to supply air to an inner passage in the turbine blade;

c) a first rim positioned along a high-pressure side of the turbine blade tip;

d) a second rim positional along at least a portion of a low pressure side of the turbine blade tip, the first and second rims defining an inner tip surface with the rims extending above the inner tip surface and toward the inside of the turbine casing with the first rim extending farther above the turbine blade tip surface than the second rim and, e) air outlets through the inner tip surface end in fluid communication with the air passageway.

5. The blade of claim 4 wherein the clearance between the first rim and the inside surface of the turbine casing is from about 0.140 up to less than 0.180 inches.

6. The blade of claim 4 wherein the inside of the turbine casing defining the
clearance with the first rim comprises a block positioned annularly around an inside of the turbine casing in a common plane with the turbine blade.

7. A turbine comprising:

a) a turbine blade wheel co-axially positioned inside a turbine casing on a rotary shaft and adapted to support a plurality of turbine blades;

b) an air passageway positioned in fluid communication with at least a portion of the turbine blades to supply air to a turbine blade tip on each turbine blade;

c) a first rim having a first height along a leading edge of at least a portion of the turbine blade tips;

d) a second rim having a second height, with the second height being less than the first height along at least a portion of a trailing edge of turbine blade tips;

e) a turbine blade tip surface defined by the area inside the first and second rims; and, f) a plurality of air outlets from the air passageway through the turbine tip surface, the end of the first rim extending outwardly from the turbine blade tip surface and having a clearance between the first rim and the inside of the casing from about 0.140 up to less than 0.180 inches.

8. The turbine of claim 7 wherein the clearance is from about 0.170 to about 0.179 inches.

9. The turbine of claim 7 wherein the turbine tip surface includes at least one air discharge opening between the first and second rim for the flow of air.

10. A turbine comprising:

a) a turbine blade wheel co-axially positioned inside a turbine casing on a rotary shaft and adapted to support a plurality of turbine blades;

b) an air passageway positioned in fluid communication with at least a portion of the turbine blades to supply air to a turbine blade tip on each turbine blade;

c) a first rim along a leading edge of at least a portion of the turbine blade tips;

d) a second rim along at least a portion of a trailing edge of turbine blade tips;

e) a turbine blade tip surface defined by the area inside the first and second rims; and, f) a plurality of air outlets from the air passageway through the turbine tip surface, the end of the first rim extending outwardly from the turbine blade tip surface and having a clearance between the first rim and the inside of the casing from about 0.140 up to less than 0.180 inches, the inside of the turbine casing defining the clearance with the turbine blade tip comprises a block positioned around an inside of the turbine casing in a common plane with the turbine blades.

* * * * *